United States Patent [19]

Popov et al.

[11] 3,950,601

[45] Apr. 13, 1976

[54] ELECTRIC FURNACE

[76] Inventors: Alexandr Nikolaevich Popov, ulitsa akademika Pavlova, 28, kv. 10; Leonid Savvich Katsevich, Sirenevy bulvar, 47, kv. 69; Vladimir Lvovich Rozenberg, Novolesnaya ulitsa, 18, korpus 1, kv. 148, all of Moscow, U.S.S.R.

[22] Filed: May 23, 1974

[21] Appl. No.: 472,870

Related U.S. Application Data

[63] Continuation of Ser. No. 347,473, April 2, 1973, which is a continuation of Ser. No. 123,574, March 12, 1971, abandoned.

[52] U.S. Cl. ..... 13/9 R; 13/10

[51] Int. Cl.[2] ..... H05B 7/18

[58] Field of Search ..... 13/9, 10

[56] References Cited

UNITED STATES PATENTS

| | | | |
|---|---|---|---|
| 1,338,103 | 4/1920 | Shipton | 13/9 |
| 1,479,662 | 1/1924 | Gray | 13/9 |
| 3,413,401 | 11/1968 | Dillon et al. | 13/9 |

*Primary Examiner*—R. N. Envall, Jr.
*Assistant Examiner*—Fred E. Bell
*Attorney, Agent, or Firm*—Holman & Stern

[57] ABSTRACT

An electric furnace for the melting of metallic and non-metallic charge, comprising an annular hearth which houses the electrodes connected to a power supply. The central zone of the furnace can accommodate the spouts for discharging the melt, supports with electrode holders, furnace transformers or gas cleaning devices.

7 Claims, 6 Drawing Figures

ELECTRIC FURNACE

This is a continuation, of application Ser. No. 347,473, filed Apr. 2, 1973 which in turn is a Rule 60 continuation Application of Ser. No. 123,574 filed Mar. 12, 1971, now abandoned.

The present invention relates to electric furnaces for the melting of metallic and non-metallic charges, said furnaces being employed in the production of ferralloys, matte as well as carbides and corundum.

Commonly known are electric furnaces of said type equipped with electrodes submerged in the hearth for melting the charge. The hearth in such furnaces vary in shape (circular, rectangular, triangular) and can accommodate from two to six electrodes of circular cross-section.

The furnaces are fitted with mechanisms for both vertical movement of electrodes and for rotating and tilting the furnace hearth. Such furnaces are capable of operating in either arc or arc-less mode (see a book by R. Dourer and G. Folkert "Metallurgy of Ferralloys" USSR, the Metallurgical Literature Publishing House, 1956, p. 16).

In the course of manufacture and operation of large electric furnaces a number of difficulties are encountered, Thus, in electric furnaces with a power of up to 72000 kVA generally either self-baking electrodes of a circular cross-section and 1900-mm diameter or carbon electrodes of 1500-mm diameter are utilized. When using using such heavy-size electrodes it is difficult to ensure their trouble-free operation, since the large weight and irregular heating of the cross-section of the electrodes tend to reduce their durability.

High rating electric furnaces comprise heavy structural assemblies including electrode holders and the mechanisms for the hearth rotation require considerable floor area.

In a situation where a furnace with the hearth reaching 6-7 m. in diameter is employed additional difficulties may arise due to low mechanical strength of the furnace roof having a small deflection, whereas the use of an open electric furnace results in considerably unfavorable working conditions in servicing the charging hole. In electrical furnaces with circular hearths generally the electrode power feed circuit arrangement is such that high concentration of energy in a reaction zone is actually not attained and there are power loses owing to a comparatively strong current passing through the layer located at the level of a charge hole. Large capacity electric furnaces are comparatively high, requiring therefore production premises of considerable height for their accommodation, while the arrangement of furnace-auxiliary devices (gas cleaning devices, furnace transformers and pouring devices) calls for an appreciable enlargement of the floor area. The electric furnaces with triangular hearths and angles rounded off to the radii are designed mainly for the melting of alloys by using a block-process. The bath of such a furnace, acting in that case as a hearth, is changed after each heating cycle for cooling down and further processing of the block. The electric furnaces of said construction produce also yellow vaporous phosphorus. These furnaces feature a somewhat better utilization of the input power owing to an increased concentration of electric power per unit area of the hearth surface. The electric furnaces with rectangular hearths are usually equipped with electrodes having a circular or rectangular cross-section and being arranged in a line. Rectangular electrodes are more durable since they are better heated up by current. In that case the power input of the furnace may be increased up to 100000 kVA without affecting the electrode strength. The hearth rotation in said furnaces is, however, not feasible and this results in a lower quality of the finished product and impairs the technological conditions of the furnace.

In some instances if the mechanisms for the hearth rotation are not employed it can result in a reduced output or even in impracticability of carrying out some operations needed for the melting of the charge.

Rectangular hearths and electrodes are less rigid than the round ones and require special equipment to increase mechanical strength of the furnace and electrode casings which should withstand thermal changes to which the furnace lining and electrode material are exposed.

Some extra difficulties may arise during the sealing of a closed electric furnace whereas the setting up of pouring and gas cleaning facilities along the furnaces is liable to further reduce the floor area available for servicing the furnace.

Inherent in all the heavy-size electric furnaces, as outlined above, are the common disadvantages arising from bulky construction and heavy weight of both the furnaces proper and their ancillary equipment occupying considerable floor area.

The object of the present invention is to eliminate said disadvantages.

The present invention is, essentially aimed at providing an electric furnace which together with high production rate would be more space-saving as compared with the prior-art designs.

Said object has been achieved by constructing an electric furnace for the melting of metallic and non-metallic charge comprising a hearth in which the electrodes are submerged, said hearth being, according to the invention ring-shaped.

It will enable to build electric furnaces with a power input in the range beyond 100000 kVA having the shell of adequate mechanical strength, the roof featuring high-strength properties if a closed furnace is employed, the construction being more convenient for servicing the charge hole in case of an open furnace owing to free space at the centre of such a furnace. In addition, an annular electric furnace can be built to accommodate a large number of electrodes, not less than 2 m in diameter, featuring higher durability.

It is desirable to design the electric furnace with a hearth having a trapezoidal working chamber with walls diverging upwards.

This makes it possible to increase the service life of the hearth lining in the course of operation and to provide high concentration of heat energy in the zones where endothermic reactions take place.

It is expedient to fit the inner hearth wall of the furnace with holes for discharging the melt and with tapping spouts directed into the central zone of the furnace.

In such a case a continuous or periodic casting of metal becomes feasible by means of a conveyor casting machine arranged directly beneath the furnace by virtue of which the use of several casting machines is actually obviated resulting in a great saving in floor area.

The supports with the electrode holders can be arranged in the central zone of the furnace.

This allows reduction of the furnace height and better utilization of the floor area.

It is desirable to mount the supports with electrode holders on a bed-plate fitted with a drive to rotate it about a vertical axis.

In such a case the erection of a bulky and expensive mechanism for rotating the furnace hearth would be unnecessary, while a uniform thermal field and elimination of both the crusts and an open high-temperature flame would be achieved in a more simple and less expensive manner. The central zone of the furnace can be arranged to accommodate furnace transformers connected to electrode holders.

As a result the coupling of the transformers to the electrode holders (small-length circuit) can be effected with minimum power losses. Besides, the floor area occupied by the furnace is considerably reduced.

It is also expedient to use the free central space of the furnace for locating gas cleaning facilities.

Owing to this a considerable saving in the floor area would be achieved and total hydraulic resistance of gas cleaning devices would be decreased.

To illustrate the present invention, below are described exemplary embodiments of the electric furnace, to be considered in conjunction with the accompanying drawings, wherein.

EXAMPLE 1

Figure 1:
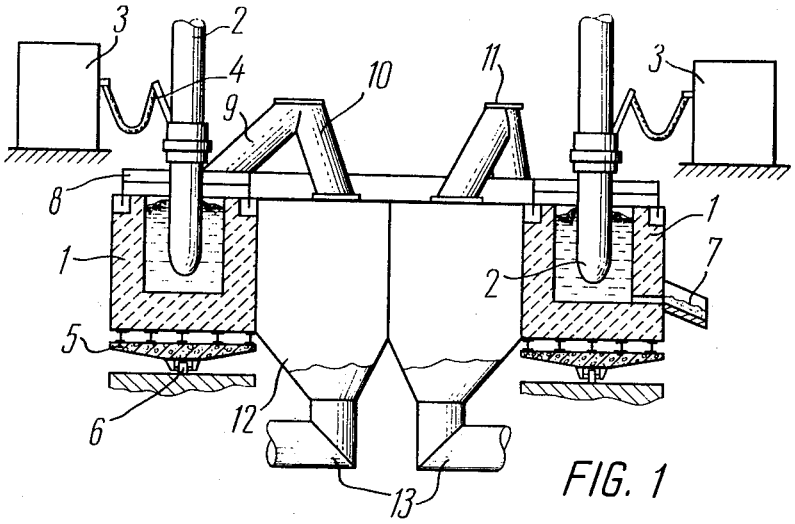
FIG. 1 illustrates in vertical section an electric furnace designed in compliance with the invention with gas cleaning devices located inside the furnace.
Figure 2:
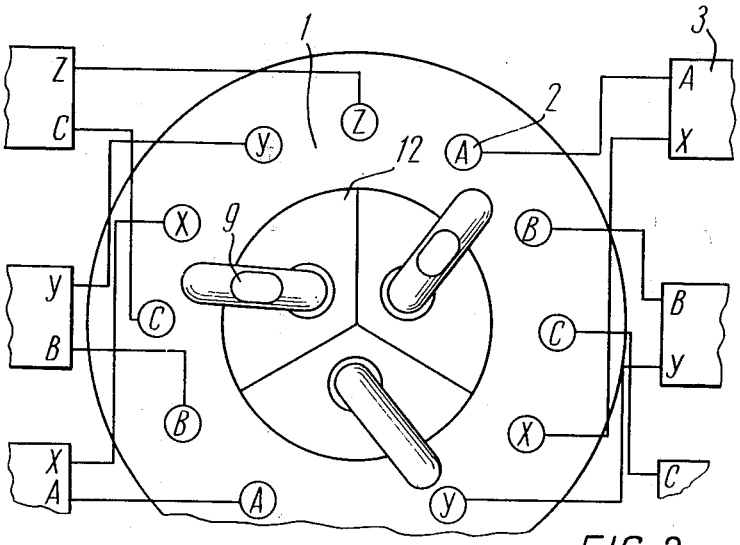
FIG. 2 is a top view of a power circuit of a furnace according to the invention.

An electric furnace for the melting of metallic and non-metallic charge is equipped with an annular hearth 1 (FIGS. 1 and 2) into which electrodes 2 are submerged. Electric power is fed to the furnace from a mains line with the aid of arc-furnace transformers 3 and circuit 4 of short length. The furnace is mounted on a bed-plate 5, set up on rollers 6 which serve to rotate the furnace hearth 1. The finished product is discharged from hearth 1 through tap holes fitted with spouts 7.

Where a closed furnace is specified, it is provided with roof 8. To purify the gases emerging from the furnace wet gas cleaners 9 are provided. The cleaners situated at the center of the furnace have inclined gas ducts 10, cleaned through the hatches closed by covers 11, multisection hollow scrubbers 12 and gas flues 13 to feed the gases into the fine gas cleaners (not shown).

The electric furnace functions as follows.

The charge for producing the specified alloy is continuously fed into the furnace hearth 1. As soon as electrodes 2 are lowered into hearth 1 current is supplied to them from a mains line through arc-furnace transformers 3 and the circuit 4. When the current passes through the elctrodes the power generated in the space under the electrodes causes heating up of the charge constituents to the melting point at which various chemical reactions take place.

In addition, the furnace hearth 1 is rotated with the bed-plate 5 on rollers 6 by means of an electromechanical drive which assures more uniform heating and stirring of the charge being melted. The finished melt is tapped from the continuously operating furnace through tapholes (openings in the hearth wall) and spout 7, the tapping being accomplished continuously or at regular intervals depending on the process being carried out.

The gases, formed in the furnace during the melting of the charge and during chemical reactions which occur in it, contain the vapours of the charge constituents (silicon, manganese). The gases are passed through apparatus 9 of the gas cleaning system.

Upon leaving the furnace the gas passes through an inclined duct 10 to hollow scrubber 12 where it is subjected to coarse cleaning to arrest larger-sized particles of dust. For ease of attending the separate sections of the furnace hearth 1, a multisection hollow scrubber 12 is employed. Next, the gas passes through a gas flue 13 into the known apparatus for fine gas cleaning (Venturi tube, uniflow cyclon).

The electric furnace is supplied with power from a threephase system with the aid of furnace transformers 3 (FIG. 2) with the transformer leads A-X, B-Y, C-Z being so connected to the furnace electrodes 2 that lead-in points A, B and C are spaced far apart from lead out points X, Y and Z. The furnace operates as described above. Besides, the furnace electrodes 2 are lowered deeper and are more stable, energy losses through the furnace charge hole are also reduced to a minimum.

EXAMPLE 2

Figure 3:
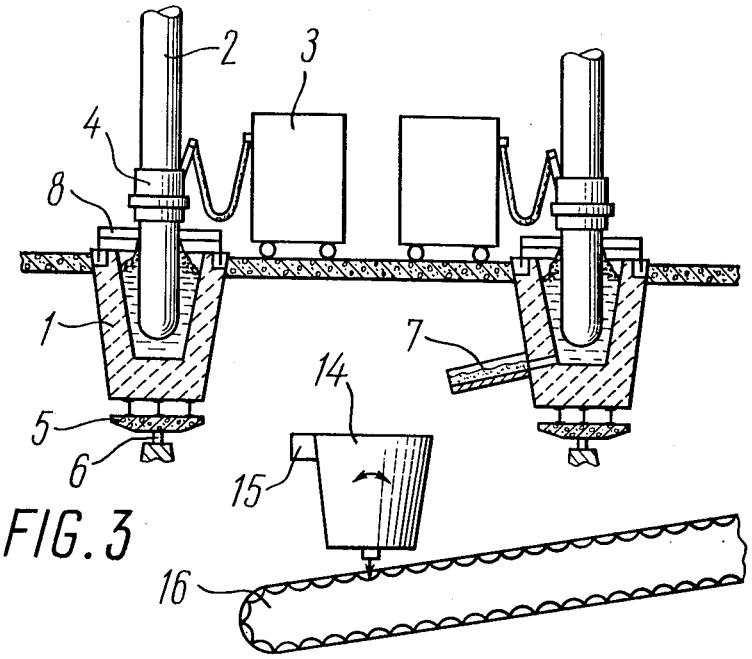
FIG. 3 shows an electric furnace with a hearth of a trapezoidal cross-section and with the furnace transformers and spouts being arranged in the free central zone of the furnace.
Figure 4:
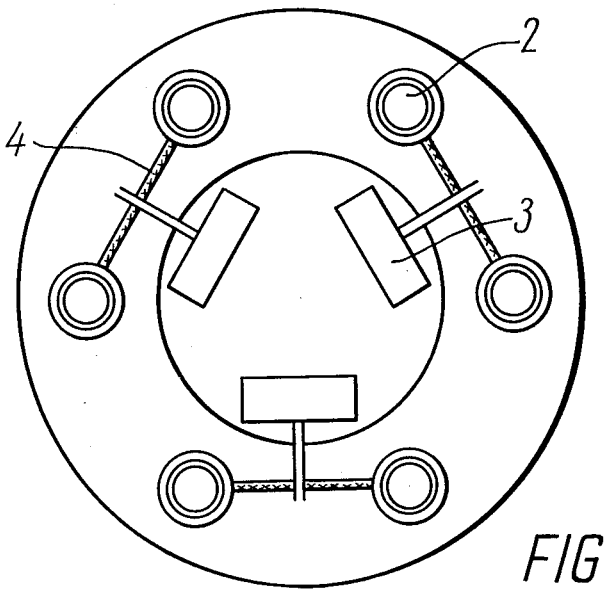
FIG. 4 is the layout of an electric furnace shown in FIG. 3.

The electric furnace in this case incorporates essentially the same structural elements as the unit considered in Example 1. But, since the spouts 7 (FIG. 3) of the trapezoidal hearth 1 are directed towards the central free space of the furnace, the latter is fitted with a device for pouring the alloy into said device comprising a ladle 14 having a pouring lip 15 and the device is arranged on a conveyor 16. Furnace transformers 3 are arranged in the free space inside the annular furnace.

The finished alloy is discharged through a tapping hole and the spout 7 into ladle 14; when the latter is inclined the alloy overflows from pouring lip 15 into the receivers of conveyorized casting machine 16 where it solidifies to be unloaded at the storehouse for finished products.

In other respects the furnace operation in this case is similar to that described in the first example.

EXAMPLE 3

Figure 5:
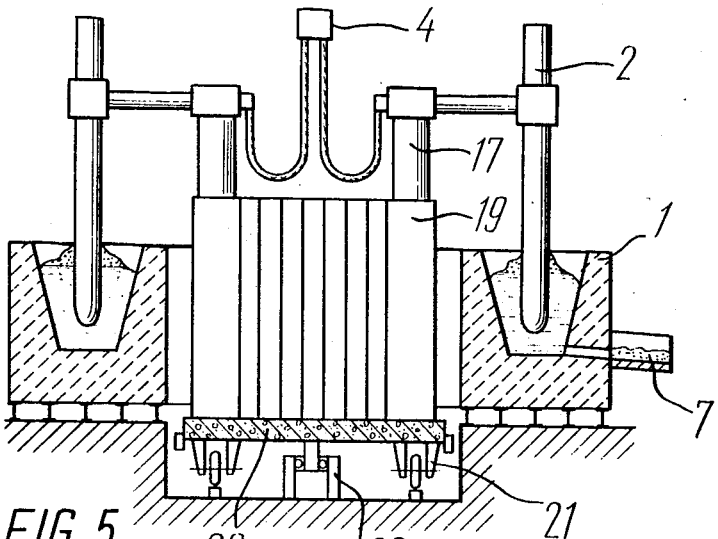
FIG. 5 shows a vertical section of an electric furnace with the electrode holder supports set up on a rotary bed-plate.
Figure 6:
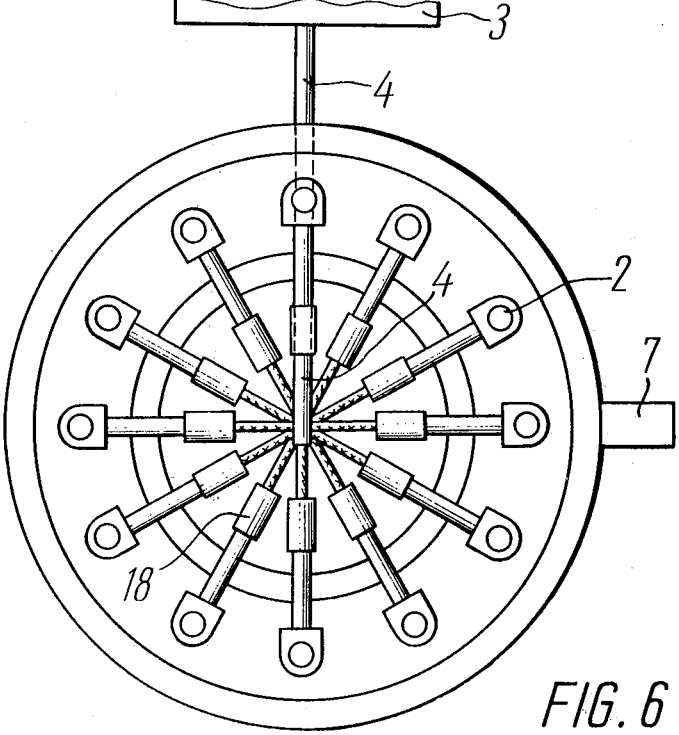
FIG. 6 shows a layout of an electric furnace illustrated in FIG. 5.

The electric furnace in this case also is provided with annular hearth 1 (FIGS. 5 and 6) and electrodes 2. The furnace is supplied with power with the aid of arc-furnace transformers 3 and small-length circuit 4. Furnace electrodes 2 are lowered or raised by supports 17 of electrode holders 18, riding in guides 19 located inside the furnace on bed-plate 20.

To tap the finished alloy the furnace is provided with tapping holes and spouts 7. For rotation of supports 17 with electrode holders 18 and guides 19 about a vertical axis when the furnace hearth 1 is stationary the furnace is fitted with a rotation gear comprising bed-plate 20 with roller assembly 21 revolving in vertical bearing 22.

In this embodiment too the furnace operation is similar to that in the described in Example 1. Supports 17 of elctrode holders 18 with guides 19 and electrodes 2 are rotated continuously or at regular intervals due to which a uniform heating of the hearth is provided.

As the tests of the described electric furnace have shown, total electrical resistance of annular hearth 1 incorporating twelve electrodes is comparable with that of the round hearth furnace, whereas the furnace power input may be in excess of 126 MVA. In this arrangement the furnace is easily serviceable.

What is claimed is:

1. An electric furnace for the melting of metallic and non-metallic charge comprising: an annular hearth in which the charge is placed, an annular furnace roof, and a plurality of electrodes passing through said roof and arranged in said hearth, a power supply source to which said electrodes are connected, and means for causing relative circular movement between said annular hearth and said plurality of electrodes about an axis of said annular hearth.

2. An electric furnace as claimed in claim 1, in which said hearth has a working chamber of trapezoidal cross section diverging upwards.

3. An electric furnace as claimed in claim 2, in which the inner hearth wall is fitted with tapping holes for discharging the molten charge, with spouts on the tapping holes being directed radially inwards into the central zone of the furnace.

4. An electric furnace as claimed in claim 3, having a central zone inside the annular hearth, the zone housing electrode holders and supports therefor.

5. An electric furnace as claimed in claim 4, in which said supports together with said electrode holders are mounted on a bed-plate equipped with a drive to rotate it about vertical axis.

6. An electric furnace as claimed in claim 4, wherein said power supply source comprises furnace transformers coupled to said electrode holders which transformers are located in said central zone.

7. An electric furnace as claimed in claim 1, with a central zone in the center of the annular hearth,, the zone including gas cleaning devices accommodated therein.

* * * * *